US006789515B1

(12) United States Patent
Marchisseau

(10) Patent No.: US 6,789,515 B1
(45) Date of Patent: Sep. 14, 2004

(54) METHOD AND DEVICE FOR MODIFYING THE COMPRESSION RATE TO OPTIMIZE OPERATING CONDITIONS OF RECIPROCATING PISTON ENGINES

(75) Inventor: Michel Alain Léon Marchisseau, Limoges (FR)

(73) Assignees: Institut Francais du Petrole, Rueil Malmaison Cedex (FR); Michel Alain Leon Marchisseau, Limoges (FR)

( * ) Notice: Subject to any disclaimer, the term of this patent is extended or adjusted under 35 U.S.C. 154(b) by 0 days.

(21) Appl. No.: 10/148,393

(22) PCT Filed: Nov. 28, 2000

(86) PCT No.: PCT/FR00/03324

§ 371 (c)(1),
(2), (4) Date: Oct. 2, 2002

(87) PCT Pub. No.: WO01/40641

PCT Pub. Date: Jun. 7, 2001

(30) Foreign Application Priority Data

Nov. 30, 1999 (FR) ..... 99 15104
Jul. 10, 2000 (FR) ..... 00 08947

(51) Int. Cl.[7] ..... F02D 15/02
(52) U.S. Cl. ..... 123/78 C; 123/48 C
(58) Field of Search ..... 123/78 C, 48 C, 123/48 B

(56) References Cited

U.S. PATENT DOCUMENTS 4,517,931 A * 5/1985 Nelson ..... 123/48 B
4,917,066 A * 4/1990 Freudenstein et al. .... 123/48 B
5,136,987 A * 8/1992 Schechter et al. ..... 123/48 B
5,163,386 A * 11/1992 Schechter ..... 123/48 B
5,335,632 A * 8/1994 Hefley ..... 123/48 B
5,605,120 A * 2/1997 Hedelin ..... 123/78 C
6,491,003 B2 * 12/2002 Moteki ..... 123/48 B
6,561,142 B2 * 5/2003 Moteki et al. ..... 123/48 B

* cited by examiner

*Primary Examiner*—Henry C. Yuen
*Assistant Examiner*—Jason Benton
(74) *Attorney, Agent, or Firm*—Antonelli, Terry, Stout & Kraus, LLP

(57) ABSTRACT

The invention relates to the modification of the compression ratio using technologies similar to traditional engine parts.

Turbines (26) and (81) set up to act in the reverse direction drive a screw (32) and shift the pivot (29) which articulates the rod (35) integral with a cam (8*a*) located between the foot of connecting rod (6*a*) and crank pin (5).

The invention is intended in particular to increase energy efficiency and reduce engine pollution.

13 Claims, 10 Drawing Sheets

FIG.4
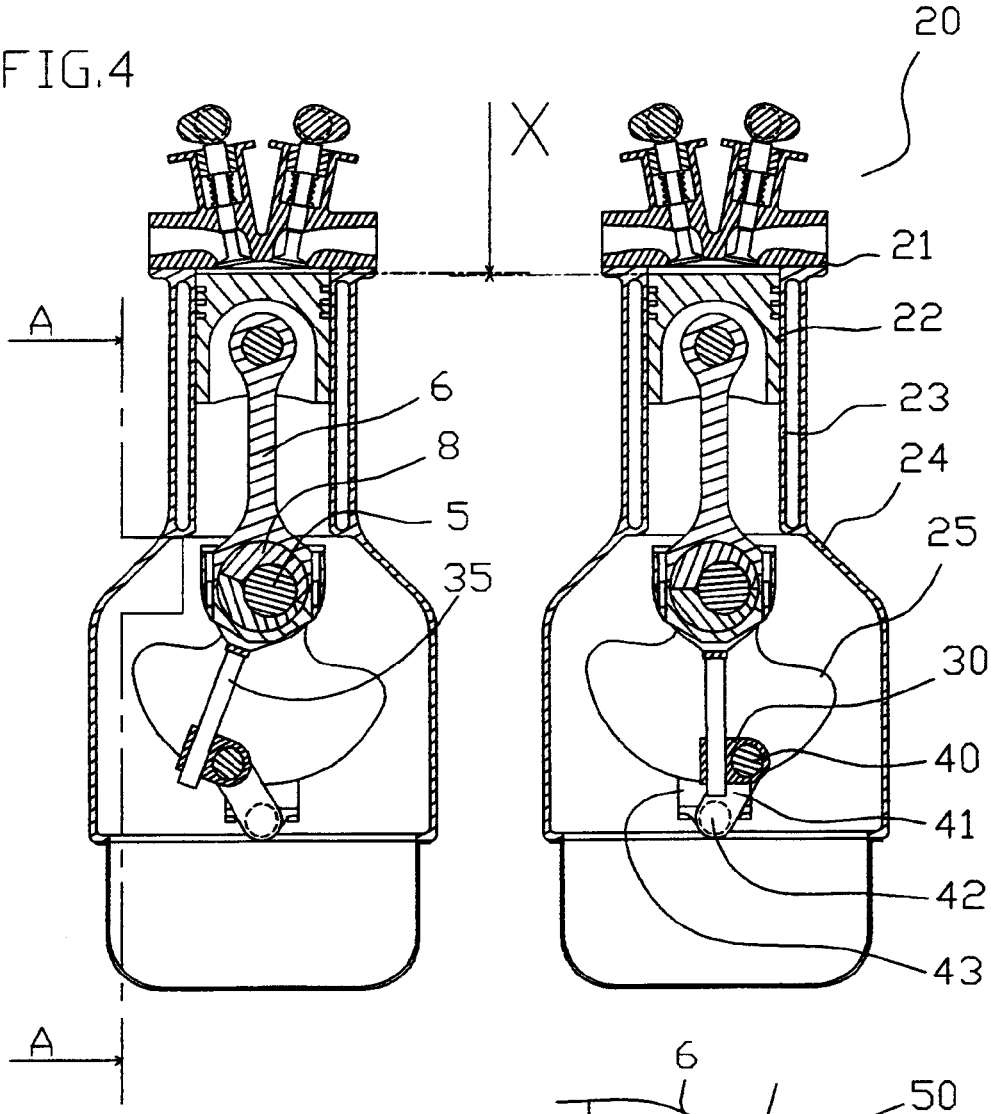
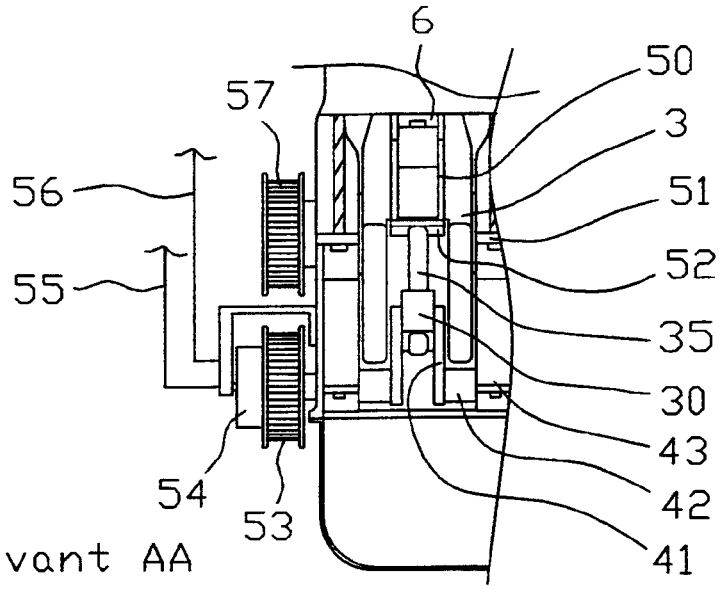
FIG.5
Coupe suivant AA

FIG.11
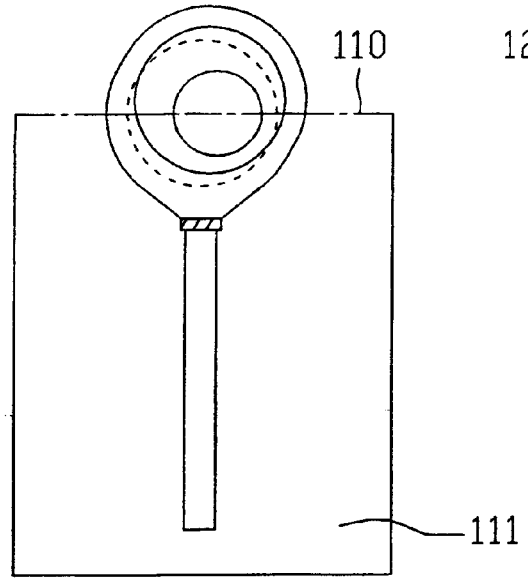
FIG.12
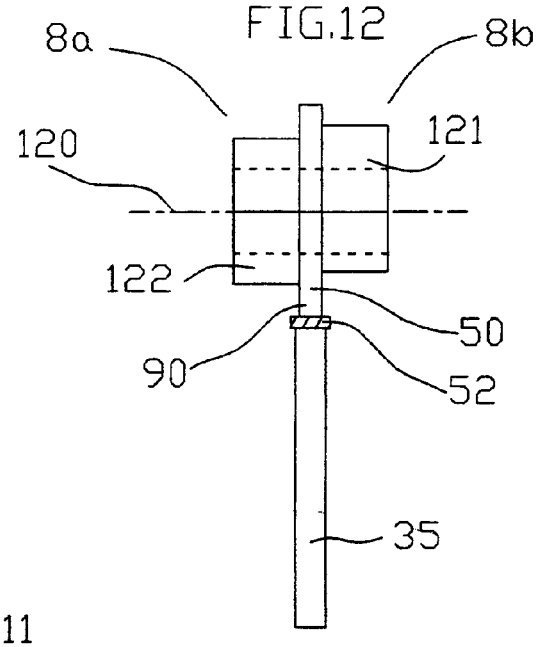
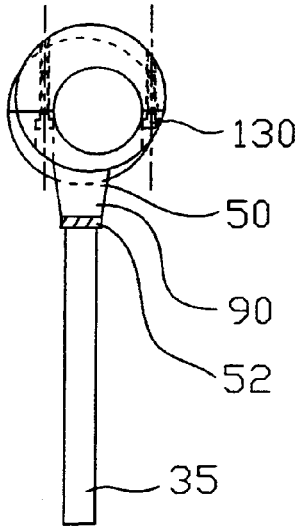
FIG.13
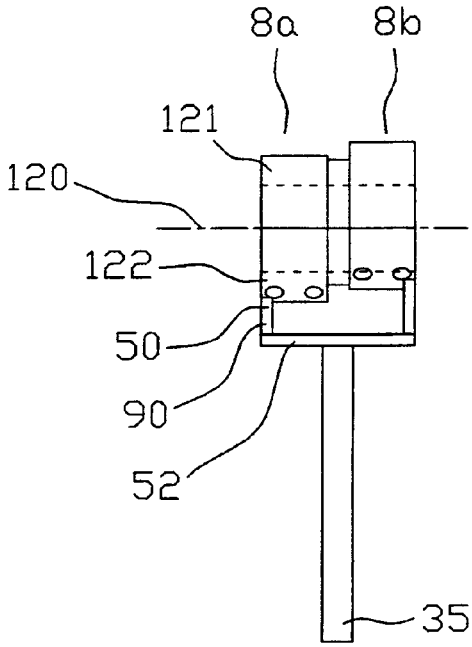
FIG.14

METHOD AND DEVICE FOR MODIFYING THE COMPRESSION RATE TO OPTIMIZE OPERATING CONDITIONS OF RECIPROCATING PISTON ENGINES

TECHNICAL AREA

The present invention relates to a method and a device that is reactive and consumes very little energy, for continuous optimization of the compression ratio, particularly of alternating-piston engines. This invention is particularly relevant to increasing the energy efficiency of engines that are not used continuously at full load or that use multiple fuels with different octane ratings. This invention is compatible with a very low pollution level and adapts in particular to alternating-piston engines whose cylinders are disposed flat, either in a "V" configuration or in-line. In the present document, the term "compression ratio" designs the geometric compression ratio of an alternating-piston internal combustion engine.

PRIOR ART

Continuous optimization of the compression ratio is relevant in reducing fuel consumption and the contribution to the greenhouse effect for applications where the engines are not at full load and for engines that use multiple fuels with different octane ratings.

Combustion in spark ignition engines operated at very low loads is more complete when the compression ratio is optimized during operation. Carbon monoxide, hydrocarbon, and particle emissions are hence lower.

Continuous optimization of the compression ratio is relevant in keeping an engine in the spark ignition operating mode by compressing a premixture of fuel and oxidant. Such a method of operation, described in particular in patent WO 99 42718 A, enables a very low nitrogen oxides emission level to be reached.

Moreover, optimization of the compression ratio is compatible with the usual systems for reducing nitrogen oxide emissions such as exhaust gas recycling (EGR) systems or nitrogen oxide catalysts.

The prior art already contains a number of solutions for modifying the compression ratios of alternating-piston engines. A summary is provided below.

One known solution for changing the compression ratio consists of placing a moving part in the cylinder head. Patent WO 99 13206 A describes one example. This part must slide in the presence of gases undergoing combustion. The interstices must be minimized to limit unburned particles. The moving part is placed in the cylinder head with the valves and participates in the shape of the combustion chamber.

U.S. Pat. No. 2,770,224 refers to an engine whose block, divided into two articulated parts, enables the distance between each piston and the corresponding cylinder head to be varied. Patent WO 93 23664 A discloses a solution for controlling this type of device. The separation force of the two parts of the engine block is used to reduce the compression ratio and store energy. The stored energy is then used to increase the compression ratio when the engine load decreases. The operating hysteresis is limited by the energy supplied by an activator. The engine block is designed and dimensioned to provide sufficient mechanical strength for the link between the two articulated parts of the engine block, and to minimize vibrations.

Patent WO 95 29329 A describes a device having two cams at the head of each connecting rod. The angular setting of these two cams is a function of the engine load and enables the distance between each piston and the corresponding cylinder head to be modified.

One category of solutions is to modify the length of the connecting rod, for example by adding an articulation modifying the straightness of the connecting rod. Patents EP 0 520 637 A and DE 195 02 820 A belong to this category of solutions. The additional parts that transmit forces between the pistons and the crank pins must be designed and dimensioned as a consequence to ensure the required reliability.

Another category of solutions adapted more particularly for in-line engines includes cams mounted on the crankshaft bearings to modify the distance between the crankshaft axis and the cylinder head. Patents FR 2,669,676 A, U.S. Pat. No. 1,872,856, U.S. Pat. No. 4,738,230, and DE-A-3,601,528 describe devices that may be classified in this category. The rigidity of the crankshaft bearings must be compatible with the required service life. Patent DE 297 19 343 U discloses a device for ensuring the alignment between the crankshaft and the transmission.

A crank pinion mounted at the end of the crankshaft meshes with an internally toothed wheel mounted on the flywheel. The teeth of these gears must withstand the rotary vibrations of the crankshaft and meet service life and noise requirements.

Patent WO 91 10051 A refers to a cam placed between the foot of each connecting rod and the corresponding crankshaft crank pin, whose angular setting is achieved by means of gears. The gears must be designed and built to and meet service life and noise requirements.

Patents JP 7527/90, JP 7528/90, JP 125166/90, and EP 0 438 121 A1 relate to a cam mounted either at the head or at the foot of each connecting rod, whose angular position is hydraulically actuated and stabilized by a removable finger. This finger must be designed and dimensioned to ensure the required reliability and service life. This device enables the compression ratio to be adjusted discontinuously.

DESCRIPTION OF INVENTION

The invention relates to a method and device for continuous optimization of the compression ratio within ranges determined by design, particularly for in-line, V, or opposed engines. The invention has the advantage, as far as the necessary technologies are concerned, of being compatible with the technologies currently used for cylinder heads, cylinder blocks, crankshafts, and their connections with the transmissions. It also has the advantage, as far as its implementation is concerned, of allowing the use of technologies similar to technologies used in alternating-piston engines that are well understood and are of proven reliability. The particular embodiments according to the invention have other advantages listed in this description.

The present invention applies to internal combustion engines with alternating pistons driven by a crankshaft. Each of these engines has one or more combustion chambers and a crankcase. The crankcase is defined in the present description and claims as the part (or rigid assembly of parts) that provides the link between the combustion chamber or chambers and the fixed parts of the crankshaft bearings. The axis of rotation of the crankshaft journals is called the crankshaft axis. These engines also have one or more cylinder heads that is/are distinct from or integral with the crankcase. Each piston is connected to a crankshaft crank pin, particularly by a piston axis, a connecting rod, and a cam. This cam is located between the foot of the connecting rod and the crankshaft crank pin that corresponds to a given combustion chamber. The change in angular setting of one of the cams relative to the crankcase brings about a change in the compression ratio of the corresponding combustion chamber. In the description and claims of the present invention, a piston is at the top dead center for each complete revolution of the crankshaft when the distance between this piston and the corresponding cylinder head is at a minimum.

The method according to the invention consists of modifying the compression ratio of each combustion chamber by carrying out the functions described below, with possible differences included within tolerances compatible with correct operation and implementation options:

- moving a point in a plane orthogonal to the crankshaft axis;
- maintaining a geometric axis in a plane orthogonal to the crankshaft axis and articulating this geometric axis around the point where the projection of the point referred to in the previous subparagraph intersects the plane of rotation of this geometric axis;
- choosing another geometric axis contained in a plane also orthogonal to the crankshaft axis and maintaining parallelism and a fixed distance between the two aforesaid geometric axes so that their direction when the piston is at the top dead center and the direction of movement of the point referred to in the first subparagraph above are different;
- maintaining a fixed relative position between the geometric axis chosen according to the previous subparagraph and the cam located between the foot of the connecting rod and the crank pin of the crankshaft.

The terminology defined below will be used in the remainder of this description to designate the points, planes, and geometric axes of the method according to the invention described in the previous paragraph:

- the point moved in a plane orthogonal to the crankshaft axis will be called the moving point;
- the plane orthogonal to the crankshaft in which the moving point moves will be called the moving point plane;
- the first geometric axis defined in the method according to the invention will be called the articulated axis;
- the plane orthogonal to the crankshaft axis containing the projection of the moving point articulating the articulated axis and in which the articulated axis is maintained, will be called the projection plane;
- the projection of the moving point on the projection plane will be called the articulation point;
- the second geometric axis defined in the method according to the invention will be called the axis attached to the cam;
- the plane orthogonal to the crankshaft axis containing the axis attached to the cam will be called the lever plane.

For engines having several combustion chambers, the method according to the invention is applied to each combustion chamber whose compression ratio is to be modified.

The method according to the invention will be better understood by reading the seven paragraphs below. These seven paragraphs relate to the method according to the invention for modifying the compression ratio of a single combustion chamber of the engine.

The embodiments of the invention relate to the exact geometric characteristics referred to in the method. However, any reduction to practice is manufactured with differences from the exact values given. These possible differences from the exact geometric characteristics are included in tolerances compatible with implementation options according to the method and allow correct operation of the engine.

The moving point plane, the projection plane, and the lever plane are defined relative to the crankshaft axis. The crankshaft and its axis are unable to move axially translationally relative to the crankcase. The moving point plane, the projection plane, and the lever plane thus always have the same relative positions with respect to the crankcase. The movements of the articulated axis, of the axis attached to the cam, of the moving point, and of the articulation point are movements relative to the crankcase.

The articulated axis and the axis attached to the cam are kept parallel to and equidistant from each other. Each of these two axes is contained in a plane orthogonal to the crankshaft axis. Neither of these two axes changes its plane during the method according to the invention. These features have in particular the consequences listed below, obtained in practice with possible differences compatible with correct operation and implementation options:

- the articulated axis and the axis attached to the cam have the same direction;
- any movement of the articulated axis is possible only in the projection plane;
- any movement of the axis attached to the cam is possibly only in the lever plane;
- any translation of the articulated axis with a component perpendicular to itself drives the axis attached to the cam along this component;
- any translation of the axis attached to the cam with a component perpendicular to itself brings about translation of the axis articulated along this component;
- any rotation of the axis articulated around the articulation point brings about a rotation with the same angle of the axis attached to the cam around the projection orthogonal to the articulation point on the lever plane;
- any rotation of the axis attached to the cam around the axis of the corresponding crank pin of the crankshaft brings about an identical rotation of the articulated axis;
- the relative translations between the articulated axis and the axis attached to the cam parallel with each other are neither prohibited nor prescribed by the method according to the invention so that two cases are possible: either the application allows the translations referred to in this subparagraph or the application does not.

The method according to the invention is hence compatible with devices for which operation brings about a change in the distance between the articulation point and the axis of the corresponding crank pin of the crankshaft.

The method according to the invention is also compatible with devices that do not enable the distance between the articulation point and the axis of the corresponding crank pin of the crankshaft to be varied.

The angular setting of the cam on its crank pin depends on the angular setting of the axis attached to the cam and the axis articulated with respect to the crankcase. To two distinct positions of the moving point in the moving point plane, the direction between these two distinct positions of the moving point not being parallel to the direction of the articulated axis and the axis attached to the cam when the piston is at the top dead center, there correspond two different angular settings of the articulated axis, of the axis attached to the cam, and of the cam, relative to the crankcase. To these two angular settings there correspond two different compression ratios, except for specific cases where these two angular settings correspond to the same distance between the crankshaft axis and the axis of the connecting rod foot.

This paragraph lists several specific applications of the method according to the invention given as non-limiting examples. For the first application, the moving point and the articulation point are in the same plane perpendicular to the crankshaft axis. For the second, the moving point is equated with the articulation point. For these two particular applications, the moving point plane is equated with the projection plane. For the third, the articulated axis and the axis attached to the cam are in the same plane perpendicular to the crankshaft axis. For the fourth, the articulated axis and the axis attached to the cam are equated. For these latter two applications, the projection plane and the lever plane are equated. All the possible combinations between the particular applications referred to above are applications of the method according to the invention.

According to another feature, the moving point is driven translationally by a point whose movement has parallel components perpendicular to the moving point plane.

According to another feature, the method according to the invention also applies to internal combustion heat engines also having an electronic device for calculating the optimum control values for operation of these engines, sensors for measuring the values of physical magnitudes characterizing operation of these engines, and devices for adjusting the operating controls of these engines to the values calculated by the calculation devices referred to above. This method consists of three phases carried out during operation of the engines: the first phase consists of measuring the values of the physical magnitudes that characterize operation of these engines, whereby these physical magnitudes include the compression ratio, the second phase consists of calculating, as a function of the physical magnitudes measured in the first phase, the optimum values for the controlled engine parameters to maximize energy efficiency and minimize pollution, whereby these controlled parameters include the compression ratio, and the third phase consists, for each cylinder, of accomplishing the functions described below:

- moving a point in a plane orthogonal to the crankshaft axis;
- maintaining a geometric axis in a plane orthogonal to the crankshaft axis and articulating the geometric axis around the point where the projection of the point referred to in the previous subparagraph intersects the plane of rotation of this geometric axis;
- choosing another geometric axis contained in a plane that is also orthogonal to the crankshaft axis and maintaining parallelism and a fixed distance between the above two geometric axes such that their direction when the piston is at the top dead center and the direction of movement of the point referred to in the first subparagraph above of this third phase, are different;
- maintaining a relative fixed position between the geometric axis chosen according to the preceding subparagraph, and the cam located between the foot of the connecting rod and the crank pin of the crankshaft;
- controlling the movement of the point referred to in the first subparagraph of this third phase to cause the compression ratio to approximate the optimum value calculated in the second phase.

For the other feature of the method described in the foregoing paragraph, the compression ratio is measured by measuring a physical magnitude enabling the compression ratio to be calculated, for example: measuring movement of the articulation point. The other physical magnitudes measured according to this method are parts of the physical magnitudes usually taken into account when controlling alternating-piston internal combustion engines. The controlled parameters of the engine for maximizing energy efficiency and minimizing pollution, other than the compression ratio, are part of the controlled parameters normally used in controlling alternating-piston internal combustion engines.

According to another feature of the invention, the method described above is supplemented by calculating, in the second phase: the quantities of air and fuel admitted for combustion as well as the angle at which combustion is triggered according to the values of the physical magnitudes characterizing engine operation in the first phase, particularly the compression ratio, and is also supplemented by, in the third phase, the control of devices for obtaining the quantity of admitted air, the quantity of admitted fuel, and the angle at which combustion is triggered, so that the values of these three parameters are made to approximate the values calculated in the second phase, particularly according to the compression ratio.

Metering the quantity of air admitted for low loads has several advantages. The temperature at the end of combustion may be lower, thus favoring service life, energy efficiency, and nitrogen oxide emissions control. This is also a relevant parameter for maintaining an engine in the spark ignition operating mode by compressing a premixture of oxidant and fuel. Note that metering the air admitted by adjusting the settings of the inlet valves is relevant for limiting load losses at admission.

The device according to the invention, built into an internal combustion engine with alternating pistons driven by a main crankshaft having a cam located between the foot of each connecting rod and the corresponding crank pin of the main crankshaft is characterized in that each cam located between the foot of each connecting rod and the corresponding crank pin of the main crankshaft is oriented with a rod articulated on a pivot.

According to a first list of additional features of the device according to the invention, for each cam located between a connecting rod foot and the corresponding crank pin of the main crankshaft, the rod is integral with the cam and part of this rod slides in a part articulated to the pivot axis. This pivot is fixed or articulated, either on a slide or on the articulated arms of a rocking arm. The slide or the rocking arm is guided by a guide system and held in position. The assembly is designed so that, during operation, the geometric characteristics included in tolerances compatible with the implementation possibilities, and with the correct operation of the device and the engine, are respected. These geometric characteristics are the following: the axis of the sliding part of the rod is in a lever plane perpendicular to the axis of the main crankshaft, the movements of the pivot, of the slide, or the articulated arms occur in planes perpendicular to the axis of the main crankshaft, and the axis of the pivot is parallel to the axis of the main crankshaft.

According to a second list of additional features of the device according to the invention, for each cam located between a connecting rod foot and the corresponding crank pin of the main crankshaft, part of the rod slides in a part integral with the cam. This sliding rod is also integral with a part articulated to the pivot axis. This pivot is attached or articulated, either on a slide or on the articulated arms of a rocking arm. The slide or rocking arm is guided by a guide system and held in position. The assembly is designed so that, during operation, the geometric characteristics included in tolerances compatible with the implementation possibilities, and with the correct operation of the device and the engine, are respected. These geometric characteristics are the following: the axis of the sliding part of the rod is in a plane perpendicular to the axis of the main crankshaft, the movements of the pivot or the articulated arms occur in planes perpendicular to the axis of the main crankshaft, and the axis of the pivot is parallel to the axis of the main crankshaft.

According to a third list of additional features of the device according to the invention, for each cam located between a connecting rod foot and the corresponding crank pin of the main crankshaft, the rod is integral with the cam and with a part articulated by the pivot axis. The pivot is attached to the articulated arms of a rocking arm. The assembly formed by all the pivots and all the articulated arms of the rocking arms enabling the rods integral with the cams that are located between the feet of the connecting rod and the corresponding crank pins of the main crankshaft to be oriented are designed to form an orientation crankshaft. Each pivot articulating the direction of a rod integral with a cam forms a crank pin of this orientation crankshaft and each articulated arm of the corresponding rocking arm forms a lever connecting this crank pin to the corresponding journal of this orientation crankshaft. The orientation crankshaft is guided and oriented by a guide system. This guide system has a frame articulated to an axis that is fixed relative to the crankcase and is held in position. The fixed parts of the bearings of the orientation crankshaft are integral with this articulated frame. The guide system and the orientation crankshaft are designed so that, during operation, the geometric characteristics included in tolerances compatible with the implementation possibilities, and with correct operation of the device and the engine, are respected. These geometric characteristics are the following:

- the articulation axis of the frame is equated with the axis of the main crankshaft;
- each pivot and the axis of the orientation crankshaft are parallel to the axis of the main crankshaft;
- the movements of each pivot are executed in planes perpendicular to the axis of the main crankshaft;
- the length of the lever of each crank pin of the orientation crankshaft is equal to the length of the lever of the corresponding crank pin belonging to the main crankshaft;
- the orientation crankshaft is rotationally connected to the main crankshaft so that the crank pin levers of these two crankshafts are always parallel.

According to one embodiment of the device according to the invention, each cam located between a connecting rod foot and the corresponding crank pin of the main crankshaft is oriented with the aid of a rod articulated to a swivel joint. The other aforesaid features remain unchanged.

The device according to the invention or its structural variant described in the preceding paragraph, associated with any one of the three lists of above-identified additional features, meets all the requirements of the method according to the invention. The guide system, the pivot or swivel joint, and the slide or rocking arm defined above conform to the characteristics described in the method according to the invention for the moving point, the articulation point, the moving point plane, and the projection plane. The pivot or swivel joint forms an articulation point, and its movements and the movements of the slide or of each articulated arm of the rocking arm form planes perpendicular to the axis of the main crankshaft; these planes correspond to the definition of the projection plane and the moving point plane. Several slide and rocking arm points correspond to the definition of the moving point. The projection of the direction of the rod on the projection plane corresponds to the definition of the articulated axis. Movement of any point of the cam as the main crankshaft rotates defines a plane that corresponds to the definition of the lever plane. The projection of the direction of the rod on the lever plane corresponds to the definition of the axis attached to the cam.

According to a fourth list of additional features of the invention, the engine includes an electronic calculator. The position of the slide or the articulated arms, for each cam located between a connecting rod foot and the corresponding crank pin of the main crankshaft, is calculated by the electronic calculator, in view of the possibilities defined by the mechanical design of the engine. The fourth list of features described in this paragraph may complete the device according to the invention or its structural variant, taken alone or in combination with any of the other three lists of additional features given above.

According to another feature, an activator uses some of the enthalpy of the exhaust gases to contribute to modifying the compression ratio.

According to another feature, the device according to the invention, in any of the versions described above, incorporates the feature described in the previous paragraph.

The use of some of the enthalpy of the exhaust gases has the advantage that energy wastage through the exhaust system can be reduced, to activate the device modifying the compression ratio in order to improve the energy yield.

According to another feature, at least one turbine supplied with exhaust gases is used to modify the compression ratio of the engine.

According to another feature, the device according to the invention, in any of the versions described above, includes the feature described in the previous paragraph.

According to another feature, a hydraulic actuator actuates the device for modifying the compression ratio.

According to another feature, a gas cylinder acts on a booster cylinder to supply a hydraulic pressure to modify the compression ratio of the engine. This design offers greater choice in placement of the gas actuator.

According to another feature of the invention, the cams located between the feet of the connecting rods and the crank pins of the main crankshaft are joined to one or more fingers and this finger or these fingers are all oriented to a half-space defined by a plane integral with the cam, this plane containing the crank pin axis.

This design minimizes weight and space occupied.

According to another feature of the invention, two cams are joined with an angular setting such that the axes of their inside diameters are the same.

This design enables the compression ratio of two cylinders harnessed to the same crank pin of the main crankshaft to be modified.

BRIEF DESCRIPTION OF DRAWINGS

The invention will be better understood by reading the detailed description that follows of certain preferred embodiments provided solely as purely illustrative examples. In this description, reference is made to the following drawings:

FIG. 4 shows two schematic views in cross section of an in-line cylinder engine whose mechanism for modifying the compression ratio includes a rod integral with the cam that slides relative to an orientation crankshaft;

FIG. 5 shows a device for modifying the setting of the orientation crankshaft shown in FIG. 3;

FIGS. 11 to 14 show several embodiments of two joined cams having one or more fingers located in a half-plane passing through its axis.

METHODS OF IMPLEMENTING THE INVENTION

Figure 1:
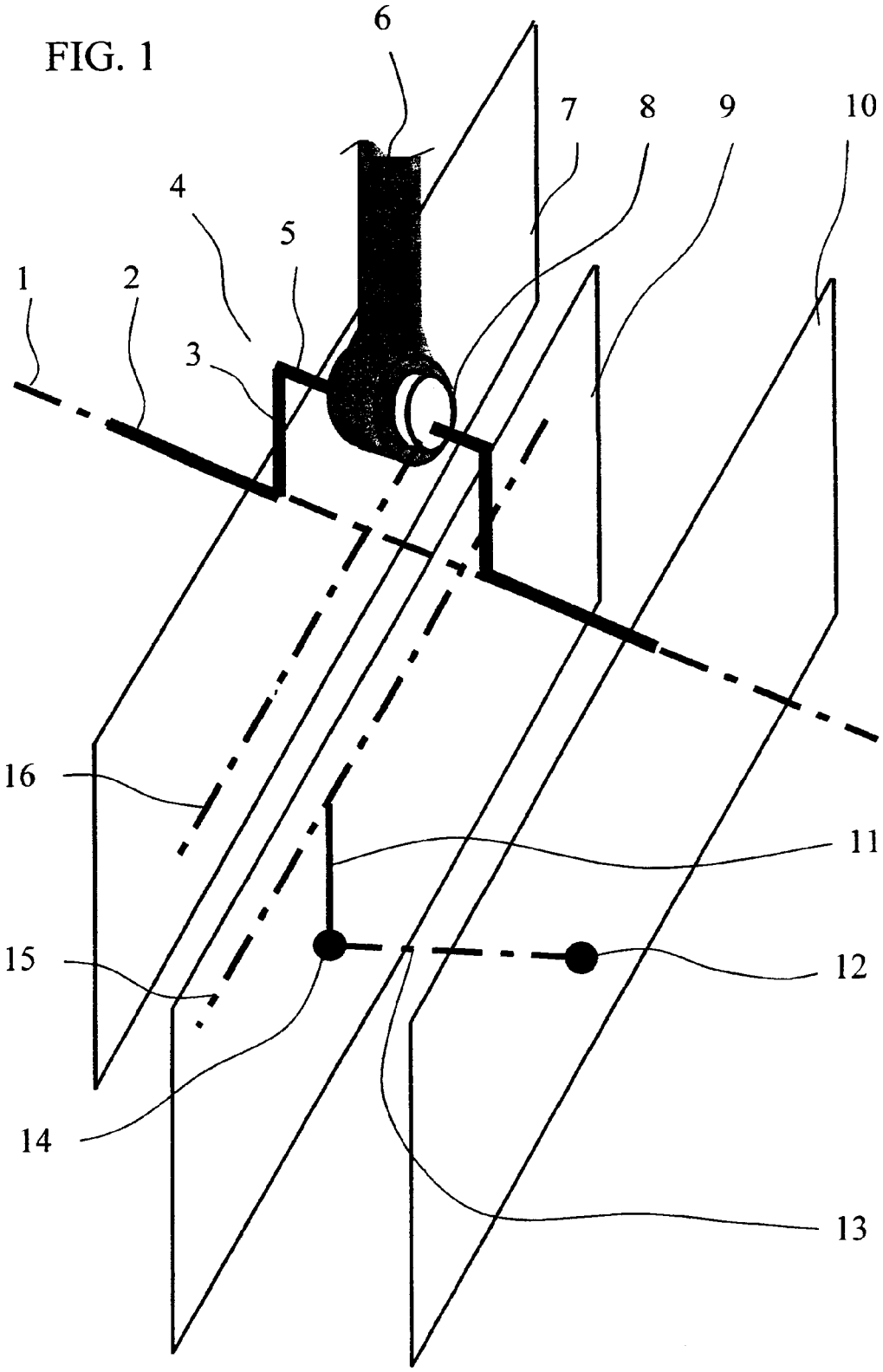
FIG. 1 is a schematic diagram of the features of the method according to the invention.

FIG. 1 shows the foot of a connecting rod (6) in which a cam (8) is located, mounted on a crank pin (5) of the main crankshaft (4) of an alternating-piston engine. The arms of lever (3) of the main crankshaft (4) connect the crank pin (5) of the journal (2). The other elements in FIG. 1 are built according to the demands of the method according to the invention. Planes (7), (9), and (10) are positioned perpendicularly to axis (1) of the main crankshaft (4); they are unable to move translationally relative to axis (1) of the main crankshaft (4); they represent, respectively, the lever plane (7), the articulation plane (9), and the plane on which moving point (10) is displaced. Point (12) is placed in the plane of moving point (10); this point represents moving point (12). The projection of moving point (12) in a direction (13) relative to articulation plane (9) defines point (14); this point represents the articulation point (14). The geometric axis (15) is contained in articulation plane (9) at a fixed distance from articulation point (14) shown by line (11); the geometric axis (15) is articulated around the articulation point (14); this geometric axis (15) represents the articulated axis (15). The geometric axis (16) is contained in lever plane (7); it is parallel to the articulated axis (15) and attached to a cam (16). Geometric axis (16) represents the axis attached to cam (16); its distance from articulated axis (15) must remain constant during operation. The geometric features described in this paragraph are maintained during operation according to the method, with differences within tolerance limits compatible with correct operation according to the method and implementation options.

During operation, when moving point (12) is moved in a different direction from the direction of articulated axis (15), the movement takes place in the plane of moving point (10) and entrains articulation point (14) in articulation plane (9). This movement of articulation point (14) moves the articulated axis (15) along a component that is radial to itself; the articulated axis (15) remains parallel to and at a constant distance from the axis attached to cam (8). The articulated axis (15) and the axis attached to cam (16) thus pivot around articulation point (14) and around the crank pin (5) of the main crankshaft (4). As a result, the displacement of moving point (12) in a direction different from the direction of articulated axis (15) causes a change in the angular setting of cam (8).

To two distinct positions of moving point (12), the direction between these two positions not being parallel to the direction of the articulated axis (15) and the axis (16) attached to the cam, there correspond two different compression ratios of the corresponding combustion chamber, except for the particular case where these two positions do not change the distance between the axis (1) of the main crankshaft (4) and the axis of the foot of connecting rod (6).

The engine (20) using the method and the device has at least one cylinder head (21), **(21*a*), (21*b*), a combustion chamber, a main crankshaft (4), and a crankcase (24) that joins the combustion chamber or chambers to the fixed part of bearings (51) of the main crankshaft (4). The device according to the invention allows modification of the compression ratio of each combustion chamber which has a piston (22), (22*a*), a sleeve (23), (23*a*), (23*b*), a connecting rod (6), (6*a*), (6*b*), and a cam (8), (8*a*), (8*b*) attached between the crank pin (5) of the main crankshaft (4) and the foot of connecting rod (6), (6*a*), (6*b*)**.

Figure 8:
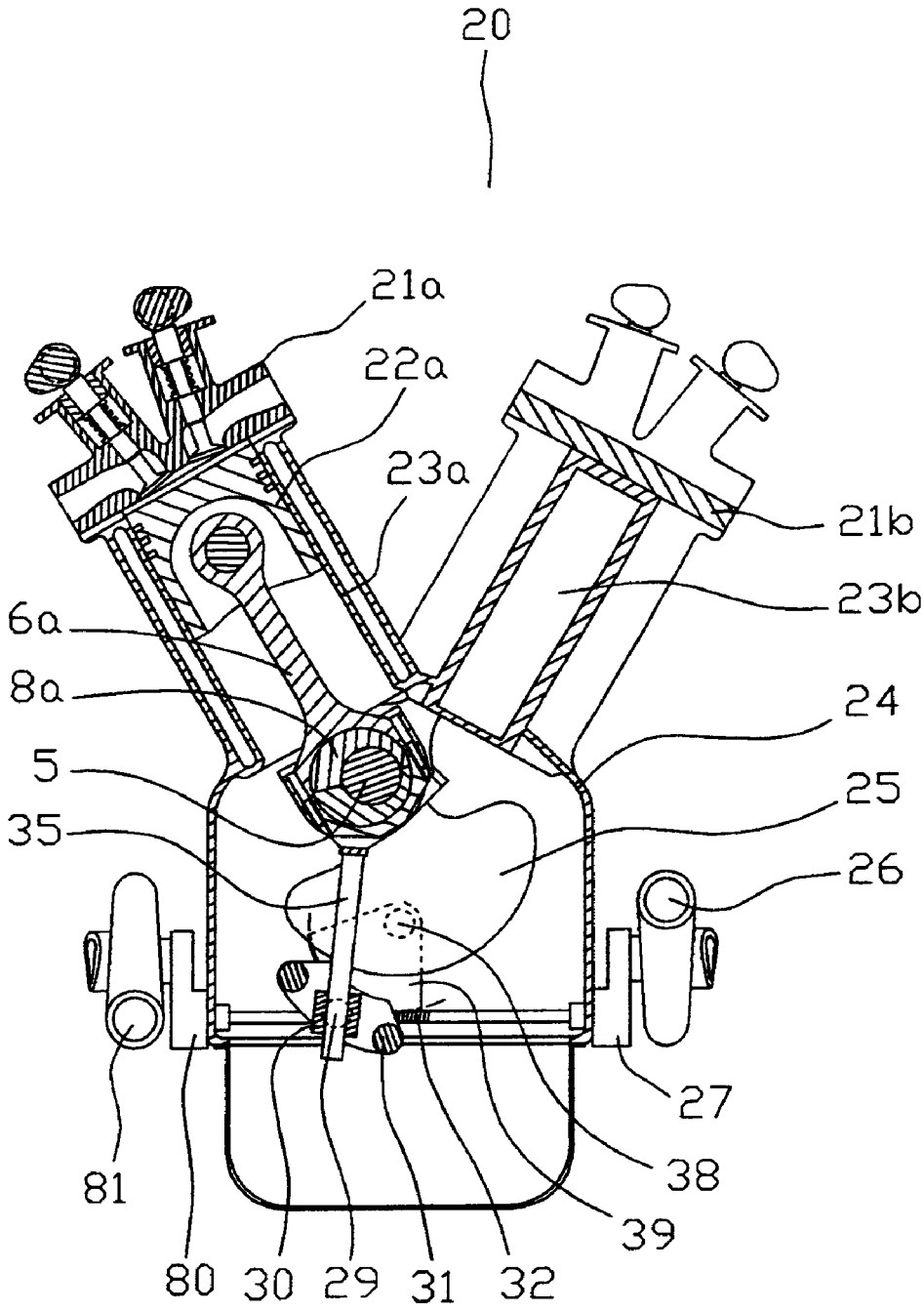
FIG. 8 shows two schematic views in cross section of a V cylinder engine whose mechanism for modifying the compression ratio includes a rod integral with the cam that slides relative to a rocking arm.

The preferred method of implementing the invention is shown in FIGS. 8 and 14. The device for altering the compression ratio orients each cam (8), **(8*a*), (8*b*) located between the foot of a connecting rod (6), (6*a*), (6*b*) and the corresponding crank pin (5) of the main crankshaft (4) of engine (20) with the aid of a rod (35) articulated on a pivot (29). Rod (35) is integral with cam (8), (8*a*), (8*b*), with a flange (50), and with a finger (90); this finger (90) is oriented to a half-space defined by a plane (110) integral with cam (8), (8*a*), (8*b*); this plane contains the axis of crank pin (5) of main crankshaft (4). Rod (35) slides in the articulated part (30) attached to pivot (29). Pivot (29), represented by a circle drawn in a dashed line in FIG. 8, is articulated in the articulated arms of a rocking arm (39). The system guiding rocking arm (39) includes the pivot axis (28) represented by a circle drawn in a dashed line in FIG. 8. During operation, rocking arm (39) pivots around this pivot axis (38). The position of the pivot axis (38) enables operation without interfering with the running part of engine (20). The assembly is designed so that, during operation, the geometric characteristics included in tolerances compatible with the implementation possibilities, and with the correct operation of the device and the engine, are respected. These geometric characteristics are the following: the axis of the sliding part of rod (35) is in a lever plane (7) perpendicular to the axis (1) of main crankshaft (4), the movements of pivot (29) and the articulated arms of rocking arm (39) occur in the projection planes (9) and the movement planes of moving point (10) perpendicular to axis (1) of the main crankshaft (4), and the axis of pivot (29) is parallel to the axis (1) of the main crankshaft (4). The articulated arms of rocking arm (39) are kept in position by the device described hereinbelow. Teeth are attached to one of the articulated arms of rocking arm (39). The other arms of rocking arm (39) are joined rotationally to these teeth by cross members (31). The aforementioned teeth mesh with screw (32). Screw (32) is guided rotationally in crankcase (24) and coupled rotationally to two turbines (26) and (81) by two reduction gears (27) and (80). The direction of rotation of the two turbines (26) and (81) is such that one of the two turbines (26) provides a rotational torque to screw (32) in the reverse direction to the rotational torque supplied by the other turbine (81). These two turbines (26) and (81) are supplied with the exhaust gases of engine (20) through controlled lines and valves, not shown. These valves are operated by an engine computer (20) to cause the compression ratio of engine (20**) to approximate the values calculated by this computer.

Figure 3:
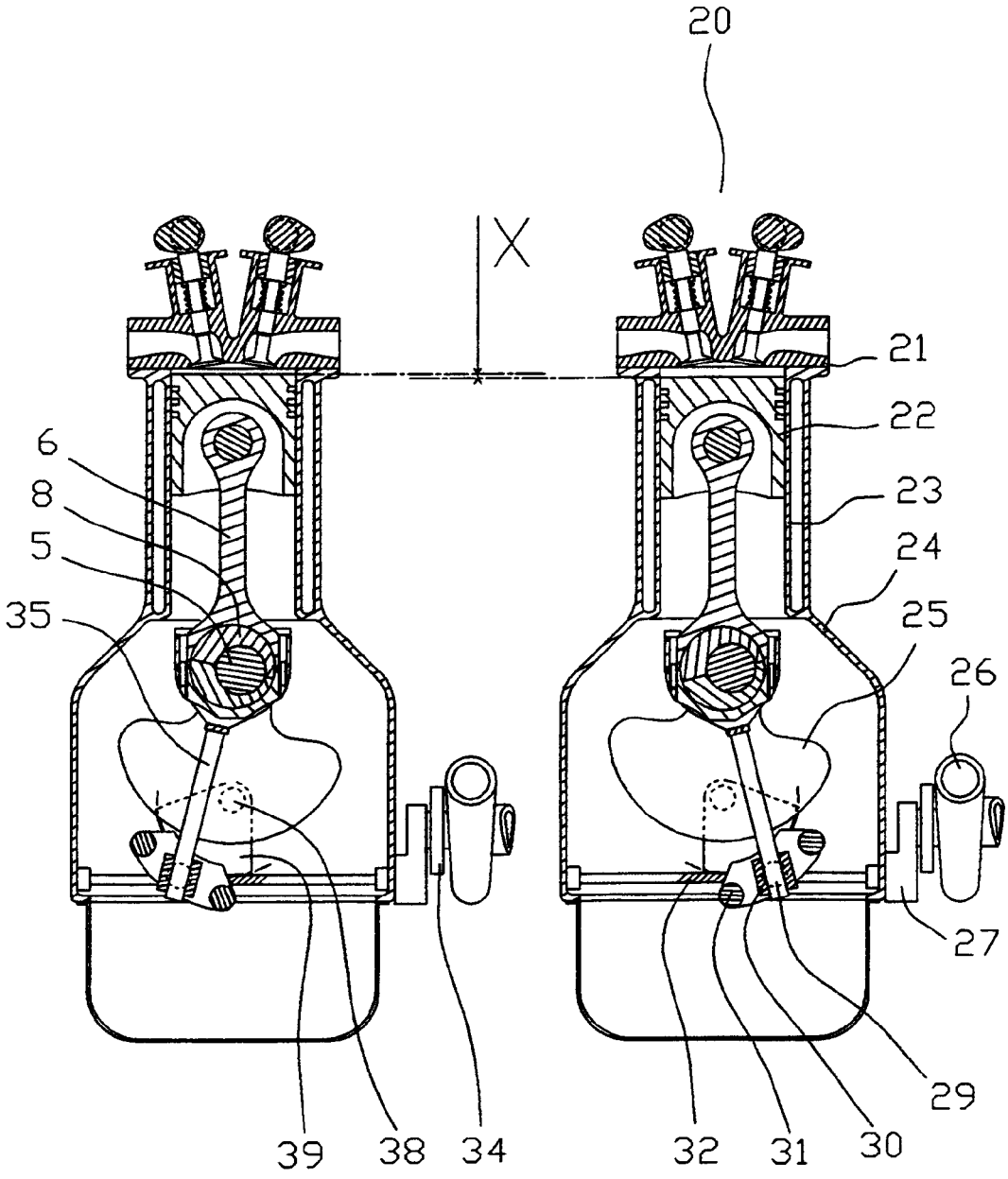
FIG. 3 shows two schematic views in cross section of an in-line cylinder engine whose mechanism for modifying the compression ratio includes a rod integral with the cam that slides relative to a rocking arm.

FIG. 8 shows the preferred manner of implementing the invention, applied to an engine whose cylinders are in the "V" configuration. This preferred manner of implementing the invention also applies to engines whose cylinders are in-line, opposed, or in several "V" s. For an in-line engine, FIG. 3 shows a device for orienting cam (8), comprising a rod integral with cam (8) articulated on pivot (29), this pivot (29) being articulated on the lever arms of a rocking arm (39). The running part of the engine is balanced by counterweights (25).

Figure 2:
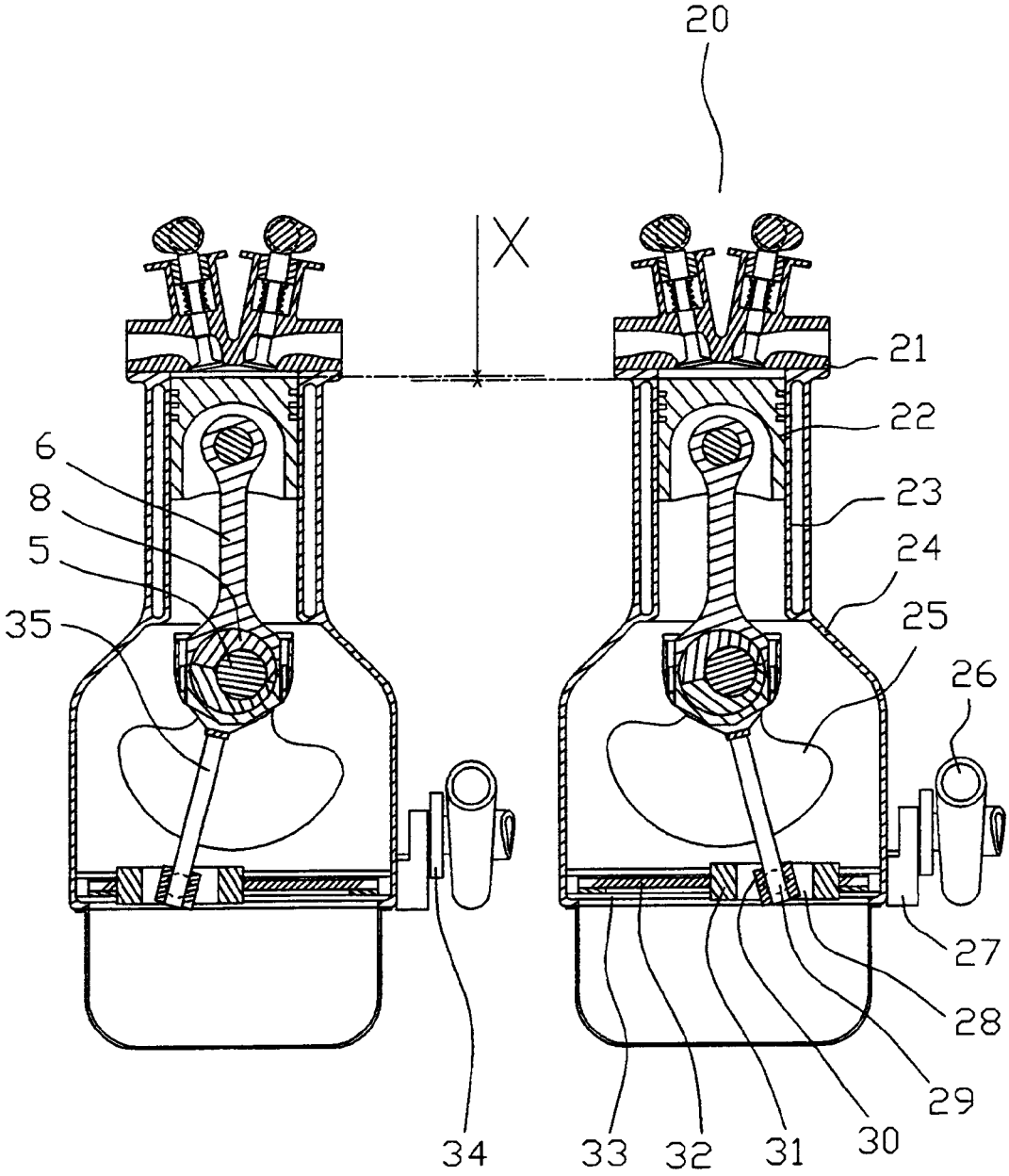
FIG. 2 provides two schematic cross sections of an in-line cylinder engine whose mechanism for modifying the compression ratio includes a rod integral with the cam which slides relative to a slide.
Figure 9:
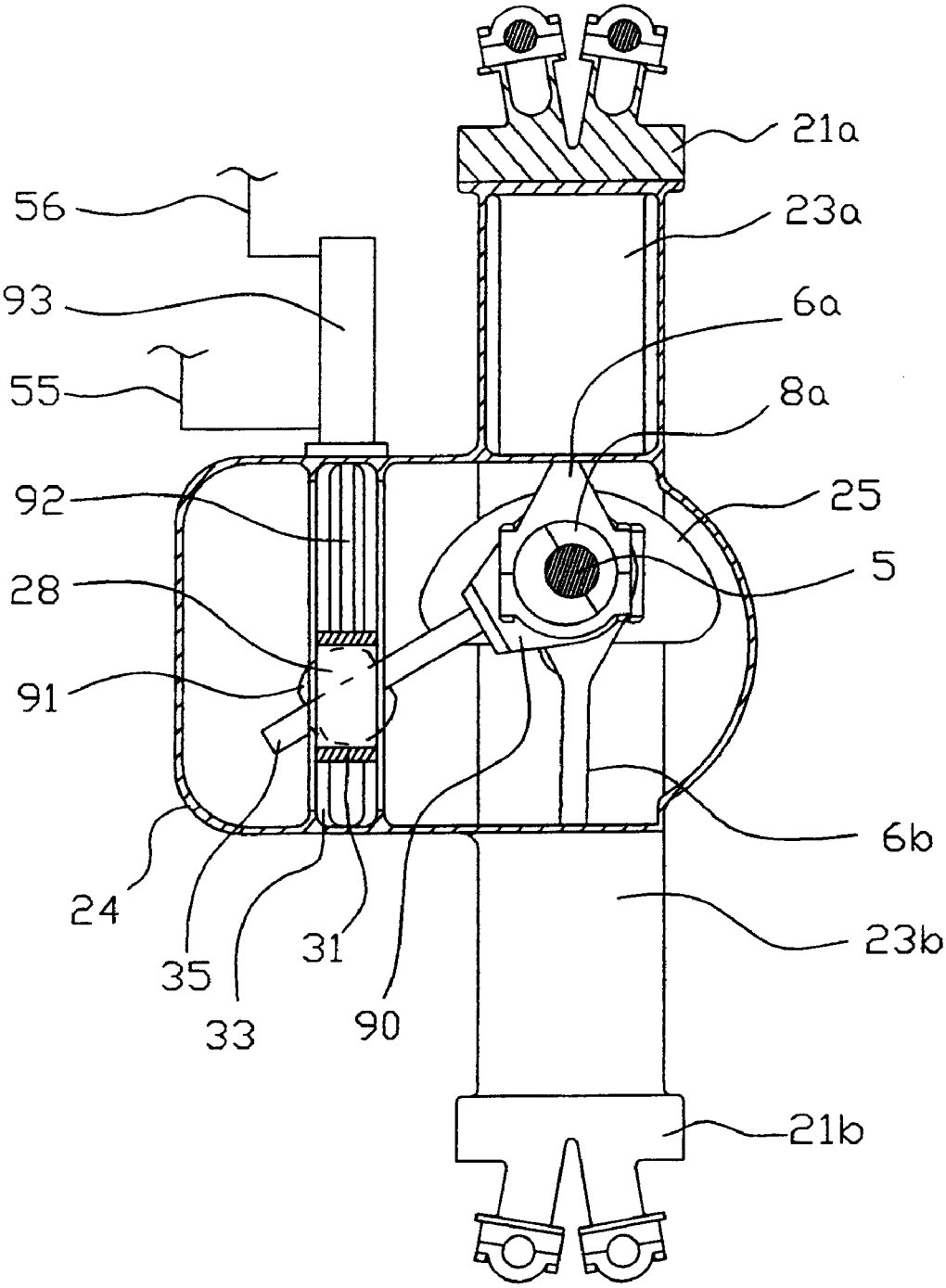
FIG. 9 provides a schematic cross section of an opposed cylinder engine whose mechanism for modifying the compression ratio includes a rod integral with the cam which slides relative to a slide.

Another method of guiding each pivot (29) according to the method consists either of articulating each pivot (29) in a slide (28), or attaching each pivot (29) in a slide (28). The system guiding each slide (28) has for example a straight-line guide (33) whose guide direction is contained in projection planes (9) and moving point (10) planes perpendicular to the axis (1) of main crankshaft (4). This other method of achieving guidance of pivot (29) is illustrated in FIGS. 2 and 9. FIG. 9 relates to an opposed engine. Rod (35) is integral with cam (8*a*) and articulated to a swivel joint (91). Swivel joint (91) is guided in slide (28).

Figure 7:
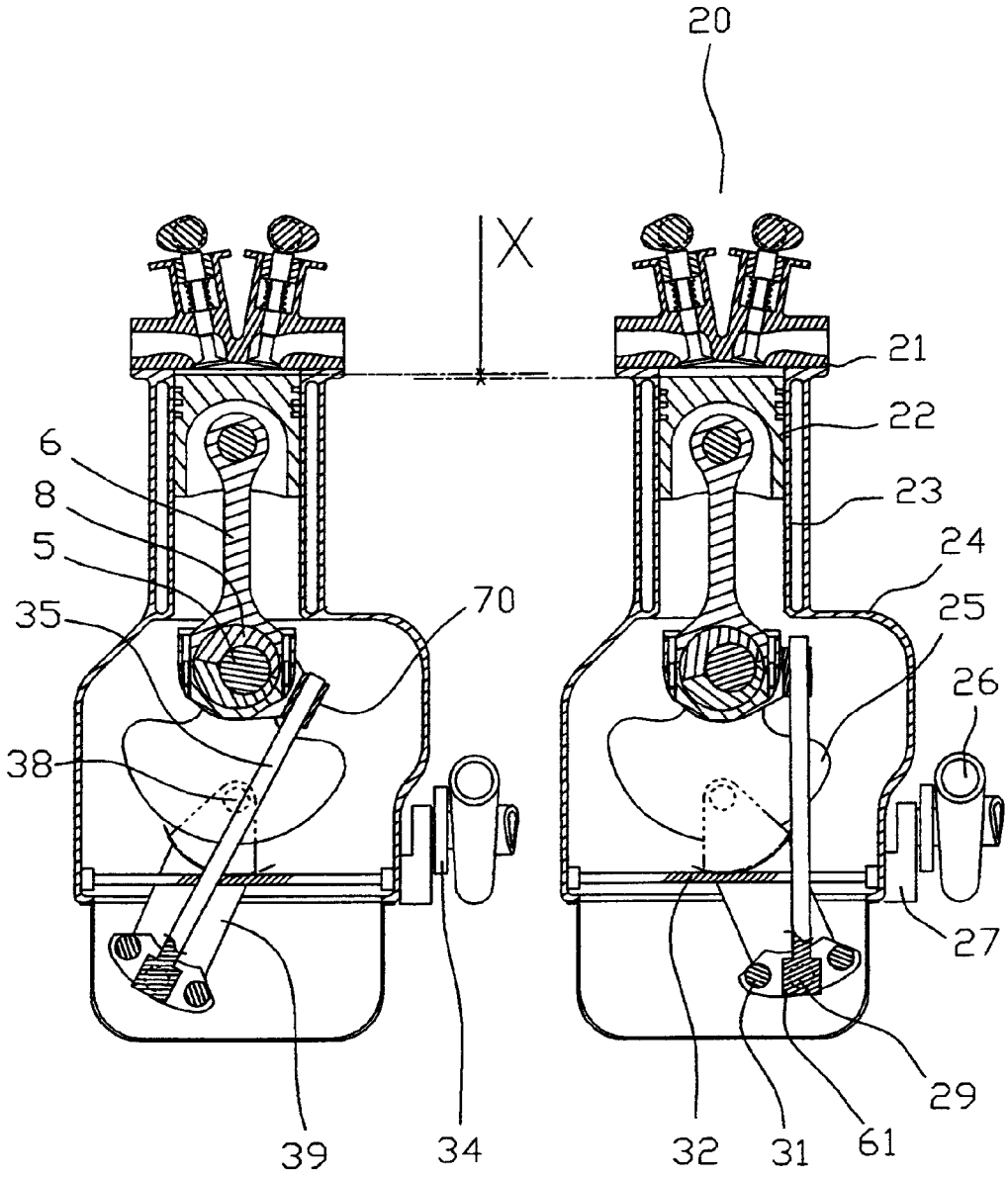
FIG. 7 shows two schematic views in cross section of an in-line cylinder engine whose mechanism for modifying the compression ratio includes a rod that slides relative to the cam and which is integral with a part guided by the pivot.

One method of limiting the number of activators of an engine (20) equipped with several cylinders (23) and a device for modifying the compression ratio with several slides (28) consists of connecting the slides (28) with each other by cross members (31). Two slides (28) are each driven by a screw (32). The two screws (32) are connected by a kinematic train to obtain identical movements for all the slides (28). Another method of orienting cam (8), (8*a*), (8*b*) with rod (35) consists of sliding rod (35) in the bore of an angular orientation part (70) integral with cam (8), (8*a*), (8*b*) and attaching rod (35) to an articulated part (61) that pivots on the axis of pivot (29) during operation. FIG. 7 illustrates this design.

Figure 6:
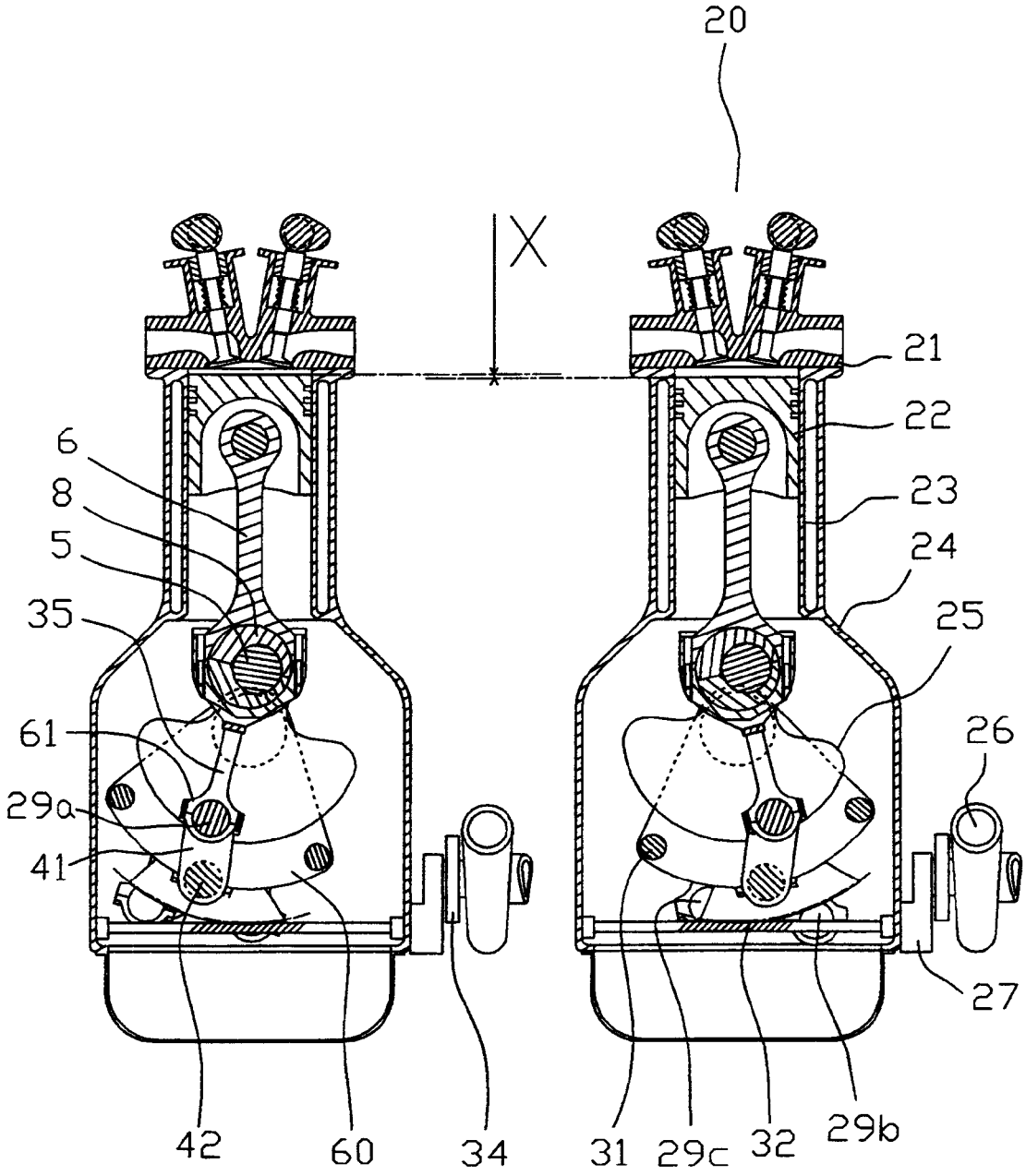
FIG. 6 shows two schematic views in cross section of an in-line cylinder engine whose mechanism for modifying the compression ratio includes a rod integral with the cam and a part guided on the crank pin of an orientation crankshaft.

Another method of implementing the invention is shown in FIG. 6. For each cam (8), (8*a*), (8*b*) located between a foot of connecting rod (6) and the corresponding crank pin (5) of main crankshaft (4), rod (35) is integral with cam (8) and with an articulated part (61) guided rotationally on the axis of pivot(29*a*), (29*b*), (29*c*). Pivots (29*a*), (29*b*), (29*c*) constitute crank pins of an orientation crankshaft. This orientation crankshaft is formed of pivots (29*a*), (29*b*), (29*c*), with levers (41) connecting pivots (29*a*), (29*b*), (29*c*) to the corresponding journals (42) of this orientation crankshaft. The orientation crankshaft is guided and oriented by a guide system that comprises a frame (60) articulated around an axis equated with the axis of the main crankshaft (4). The bearings of the orientation crankshaft are attached to frame (60). The guide system and the orientation crankshaft are designed so that, during operation, the geometric characteristics included in tolerances compatible with implementation possibilities, and with the correct operation of the device and the engine, are respected. These geometric characteristics are the following: the movements of each pivot (29*a*), (29*b*), (29*c*) are performed in the plane (9) perpendicular to the axis (1) of the main crankshaft (4), each pivot (29*a*), (29*b*), (29*c*), and axis (1) of the orientation crankshaft, are parallel to the axis (1) of the main crankshaft (4), the frame articulation axis is equated with the axis (1) of the main crankshaft (4), the length of levers (41) of each crank pin of the orientation crankshaft that constitutes the pivots (29*a*), (29*b*), (29*c*) is equal to the length of levers (3) of the corresponding crank pin (5) belonging to the main crankshaft (4), and the orientation crankshaft is rotationally linked to the main crankshaft (4) such that the levers (41) and (3) of the crank pins of these two crankshafts corresponding to one combustion chamber are always parallel, this feature being achieved by means of the fact that the main crankshaft (4) and the orientation crankshaft each have levers (41) and (3) offset by 120°. The three pivots (29*a*), (29*b*), (29*c*) are shown partially in FIG. 6.

For all the methods of guiding pivot (29), (29*a*), (29*b*), (29*c*) described above, either slide (28), or the articulated arms of rocking arm (39), or frame (60) can be driven by a screw (32) coupled to a single turbine (26) through a reduction gear (27) and a brake (34) controlled by the engine computer. The pitch of screw (32) is such that the mechanical drive is reversible. The assembly direction of turbine (26) enables the compression ratio to be increased. The pressure of the connecting rods on the cams decreases the compression ratio. Brake (34) controls the direction of modification of the compression ratio or stops this modification. The design described in this paragraph is illustrated in FIGS. 2, 3, 6, and 7.

The mechanism for modifying the compression ratio shown in FIG. 9 is driven by a hydraulic cylinder (92). This hydraulic cylinder is supplied by lines (55) and (56). It is connected to slide (28) through rod (92).

FIGS. 4 and 5 show another manner of implementing the invention. For each cam (8), (8*a*), (8*b*) placed between a foot of connecting rod (6) and the corresponding crank pin (5) of the main crankshaft (4), rod (35) is integral with the cam (8) and slides in the articulated part (30) guided on pivot (29). Pivots (29) constitute the crank pins of an orientation crankshaft. This orientation crankshaft is formed of pivots (29), and levers (41) connecting the pivots (29) to the journals (42) of this orientation crankshaft. This orientation crankshaft is guided in bearings (43) whose fixed parts are integral with crankcase (24). This orientation crankshaft is rotationally linked to the main crankshaft (4) with a toothed belt, not shown, and two pulleys (53) and (57) with the same diameter and the same number of teeth. The angular setting for the orientation crankshaft relative to the main crankshaft (4) is modifiable during operation by means of the adjuster (54). Adjuster (54) is hydraulically actuated; it is supplied with hydraulic fluid by lines (55) and (56).

The hydraulic cylinder (93) or adjuster (54) can be supplied by a hydraulic pump, not shown in the figures.

Figure 10:
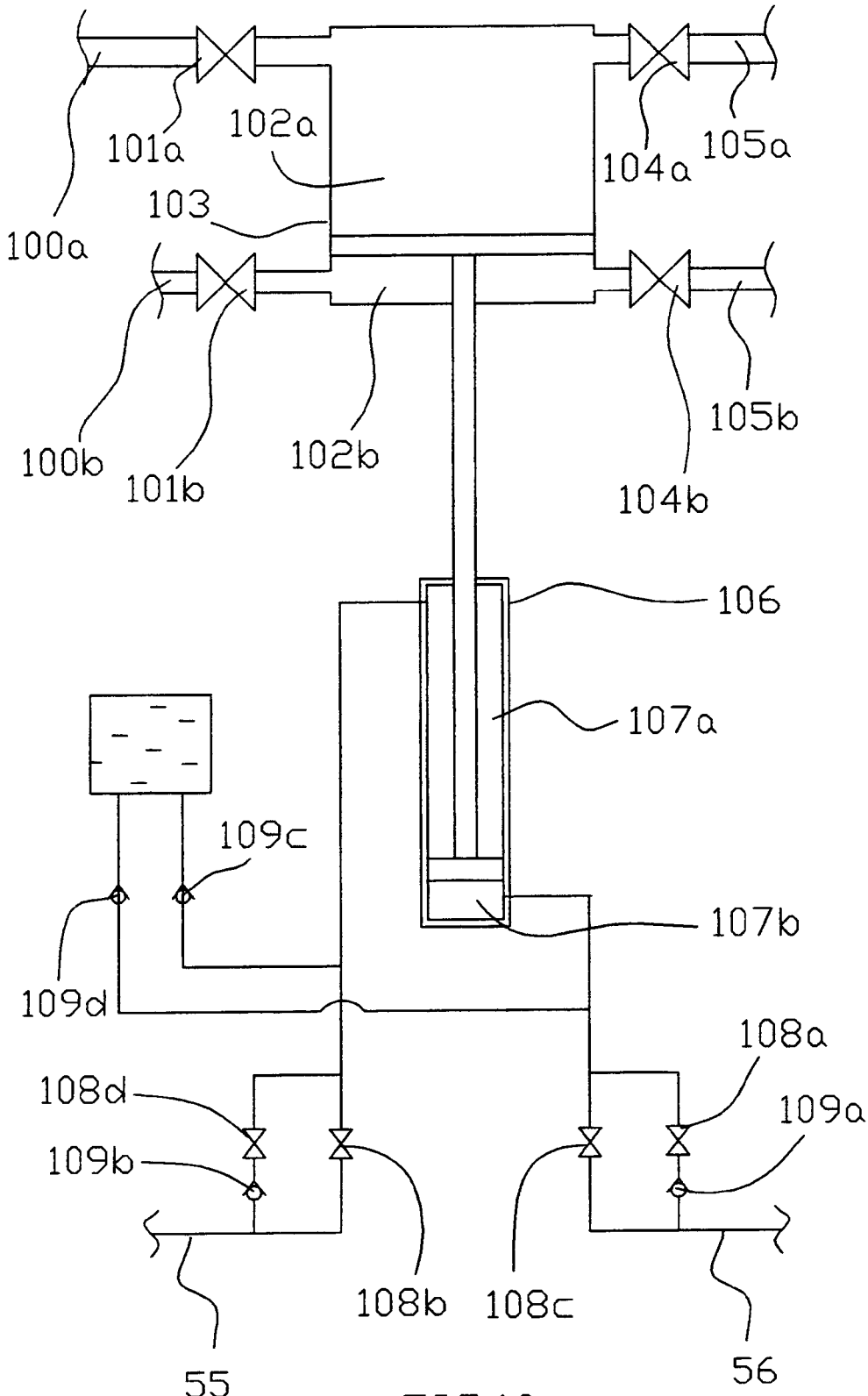
FIG. 10 provides a schematic view of a system for supplying a hydraulic cylinder or adjuster with a fluid under pressure.

Another method of supplying hydraulic cylinder (93) or adjuster (54) with a fluid under pressure is shown in FIG. 10. A gas cylinder (103) actuates a booster cylinder (106). The lines (100*a*), (100*b*) to the chambers (102*a*), (102*b*) of the gas cylinder (103) are controlled by valves (101*a*), (101*b*) and supplied with exhaust gas. The outgoing lines (105*a*), (105*b*) are controlled with valves (104*a*), (104*b*) and connected to atmosphere. Each of the two chambers (107*a*), (107*b*) of the booster cylinder (106) is connected to a hydraulic line (55) or (56) supplying the hydraulic cylinder (93) or adjuster (54), through two parallel branches, one of which is fitted with a valve (108*c*), (108*b*), and the other with a valve (108*a*), (108*d*) and a check valve (109*a*), (109*b*). This check valve (109*a*), (109*b*) checks the flow of hydraulic fluid in the corresponding branch to booster cylinder (106). Thus, if one of the two valves (108*c*) or (108*b*) which is not in series with a check valve (109*a*), (109*b*) is closed while the other three hydraulic valves are open, the only possible movement of the booster piston is the movement that decreases the volume of the chamber (107*a*), (107*b*) connected to the closed valve (108*c*) or (108*b*). This arrangement thus enables the direction of modification of the compression ratio to be easily controlled and the exhaust gases to be used.

According to another feature, the two chambers (107*a*), (107*b*) of booster (106) are also connected to a hydraulic tank through two check valves (109*c*), (109*d*). The assembly direction of these two check valves (109*c*), (109*d*) enables liquid to pass only from the hydraulic tank to the booster (106). This arrangement enables the booster to be filled in the event of a leakage, within the limits of the oil tank capacity.

According to one design variant of the assembly comprised of the gas cylinder (108) and the booster cylinder (106), the outgoing lines (105*a*), (105*b*) from the gas cylinder (103) are connected to the intake of engine (20). This variant is not shown in the figures.

Cams (8), (8*a*), (8*b*) are formed of two half-shells (121) and (122). This design, shown in FIGS. 11 to 14, facilitates assembly.

FIGS. 11 to 12 show the rigid link between rod (35) and cam (8), (8*a*), (8*b*). This rigid link between rod (35) and cam (8), (8*a*), (8*b*) consists of a plate (52), one or more fingers (90), and one or more flanges (50). Plate (52) forms the interface between rod (35) and finger or fingers (90). Finger or fingers (90) are extended by flanges (50). When these parts are assembled on engine (20), the finger or fingers (90) are outside the space occupied by the connecting rod cap and connect(s) plate (52), while the flange or flanges (50) is/are partially or totally included in the thickness of the foot of connecting rod (6) or the cap of connecting rod (6) and connect(s) cams (8), (8*a*), (8*b*).

According to the preferred method of attaching rod (35) to cam (8), (8*a*), (8*b*), the finger or fingers (90) integral with flanges (50) are all oriented to a half-space defined by a plane (10) integral with cam (8), (8*a*), (8*b*), this plane containing the axis (120) of the inside diameter of cam (8), (8*a*), (8*b*). This half-space is symbolized in FIG. 11 by rectangle (111). The axis (120) of the inside diameter of cam (8), (8*a*), (8*b*) is equated with the axis of crank pin (5) of the main crankshaft (4) when the parts are assembled on engine (20).

FIGS. 12 to 14 show several methods of constructing the link between two joined cams (8*a*), (8*b*) and rod (35). In FIG. 12, the flanges (50) separate the two cams (8*a*), (8*b*). In FIGS. 13 and 14, the two flanges (50) are irremovably attached to the half-shell (122) closest to rod (35). The two flanges (50) are placed on either side of the assembly formed by the two joined cams (8*a*), (8*b*). The half-shell (121) is attached to the half-shell (122) by retaining screws (130).

INDUSTRIAL APPLICATIONS

This invention can be applied to engines and alternating-piston compressors driven by a crankshaft, whose combustion chambers or compression chambers are in-line, opposed, in a "V" configuration, or in a plurality of "V"s.

What is claimed is:

1. Device for modifying the compression ratio of an internal combustion engine including at least one combustion chamber delimited by a cylinder head, a cylinder, and a piston with an alternating movement, said piston being connected to a connecting rod connected to a crankshaft carrying a cam interposed between the foot of said connecting rod and the crank pin of said crankshaft, said cam being rotationally linked to one end of an angularly displaceable rod connected to a part, characterized in that part pivots on an axis carried by displacement means enabling the angular setting of said cam to be changed.

2. Device according to claim 1, characterized in that part has means for sliding rod.

3. Device according to claim 1, characterized in that the displacement means include a slide.

4. Device according to claim 1, characterized in that the displacement means include a rocking arm.

5. Device according to claim 1, characterized in that the displacement means include an orientation crankshaft.

6. Device according to any one of claims 1 to 5, characterized in that it includes at least one activator actuating displacement means.

7. Device according to claim 6, characterized in that the activator is a turbine supplied by the engine exhaust gases.

8. Device according to claim 6, characterized in that the activator is a hydraulic cylinder.

9. Device according to claim 8, characterized in that a gas cylinder acts on hydraulic cylinder.

10. Device according to claim 6, characterized in that the activator is an adjuster.

11. Device according to claim 6, characterized in that the activator controls a screw connected to displacement means.

12. Device according to claim 1, characterized in that the cam comprises two cams each integral with an angular setting and rotationally linked to one and the same rod.

13. Device according to claim 7, characterized in that the activator controls a screw connected to displacement means.

* * * * *